US008998782B1

(12) United States Patent
Nelson

(10) Patent No.: US 8,998,782 B1
(45) Date of Patent: Apr. 7, 2015

(54) EXERCISE EQUIPMENT AND ADJUSTABLE BAND PEG ASSEMBLIES FOR EXERCISE EQUIPMENT

(71) Applicant: Brunswick Corporation, Lake Forest, IL (US)

(72) Inventor: Westin Nelson, Dayton, MN (US)

(73) Assignee: Brunswick Corporation, Lake Forest, IL (US)

( * ) Notice: Subject to any disclaimer, the term of this patent is extended or adjusted under 35 U.S.C. 154(b) by 326 days.

(21) Appl. No.: 13/714,139

(22) Filed: Dec. 13, 2012

(51) Int. Cl.
*A63B 21/04* (2006.01)
*A63B 21/02* (2006.01)

(52) U.S. Cl.
CPC ..... *A63B 21/04* (2013.01)

(58) Field of Classification Search
CPC .... A64B 21/02; A64B 21/04; A64B 21/0407; A64B 21/04423
USPC ..... 482/129, 104, 133, 135, 136
See application file for complete search history.

(56) References Cited

U.S. PATENT DOCUMENTS

| | | | | |
|---|---|---|---|---|
| 3,379,434 | A * | 4/1968 | Guzaldo | 482/143 |
| 3,506,261 | A * | 4/1970 | Gregory | 482/37 |
| 4,286,782 | A * | 9/1981 | Fuhrhop | 482/99 |
| 4,360,198 | A * | 11/1982 | Waulters | 482/106 |
| 7,736,286 | B2 * | 6/2010 | Panaiotov | 482/142 |
| 7,753,830 | B1 | 7/2010 | Marsh et al. | |
| 7,927,263 | B1 | 4/2011 | Marsh et al. | |

* cited by examiner

*Primary Examiner* — Bhisma Mehta
*Assistant Examiner* — Rae Fischer
(74) *Attorney, Agent, or Firm* — Andrus Intellectual Property Law, LLP

(57) ABSTRACT

An adjustable band peg assembly is for exercise equipment in an exercise zone where a user performs exercises. The assembly comprises a housing and a band peg that is connected to the housing so as to be selectively movable between an active position wherein the band peg extends into the exercise zone and an inactive position wherein the band peg is retracted away from the exercise zone.

10 Claims, 5 Drawing Sheets

EXERCISE EQUIPMENT AND ADJUSTABLE BAND PEG ASSEMBLIES FOR EXERCISE EQUIPMENT

FIELD

The present disclosure relates to exercise equipment, including weight training equipment, including weight racks and benches.

BACKGROUND

U.S. Pat. Nos. 7,753,830 and 7,927,263, the disclosures of which are hereby incorporated herein by reference in entirety, disclose exercise equipment including a weight rack frame and bench frame releasably lockable to the weight rack frame at a plurality of selectable locking locations there along.

U.S. patent application Ser. No. 13/451,304, filed Apr. 19, 2012, the disclosure of which is hereby incorporated by reference in entirety, discloses exercise equipment and adjustable band peg assemblies for exercise equipment having a base frame with a plurality of band peg holes therein. A band peg is movably connected to the base frame so as to be selectively inserted in different holes in the plurality of band peg holes while remaining connected to the base frame.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter. In some examples, an adjustable band peg assembly is for exercise equipment located in an exercise zone where a user performs exercises. The assembly comprises a housing and a band peg that is connected to the housing so as to be selectively movable between an active position wherein the band peg extends into the exercise zone and an inactive position wherein the band peg is retracted away from the exercise zone.

In other examples, exercise equipment is for use in an exercise zone where a user performs exercises. The exercise equipment comprises an axially extending base frame; and a band peg connected to the base frame so as to be selectively movable between an active position wherein the band peg extends into the exercise zone and an inactive position wherein the band peg is retracted away from the exercise zone.

In other examples, exercise equipment is for use in an exercise zone where a user performs exercises. The exercise equipment comprises an axially extending base frame. A housing is attached to the axially extending base frame. A band peg is connected to the housing so as to be selectively movable between an active position wherein the band peg extends into the exercise zone and an inactive position wherein the band peg is retracted away from the exercise zone. An axially extending support bar is spaced vertically above the base frame. The support bar is configured to support a weight bar having at least one of chains or rubber bands attached thereto. In the active position the band peg extends transversely with respect to the axially extending base frame so as to interfere with the at least one of chains or rubber bands on the weight bar and in the inactive position the band peg extends parallel to the axially extending base frame so as not to interfere with the at least one of chains or rubber bands on the weight bar.

BRIEF DESCRIPTION OF THE DRAWINGS

Examples of exercise equipment and band peg assemblies for exercise equipment are described with reference to the following drawing figures. The same numbers are used throughout the drawing figures to reference like features and components.

DETAILED DESCRIPTION OF THE DRAWINGS

In the present description, certain terms have been used for brevity, clearness, and understanding. No unnecessary limitations are to be inferred therefrom beyond the requirement of the prior art because such terms are used for descriptive purposes only and are intended to be broadly construed. The different apparatuses described herein may be used alone or in combination with other apparatuses. Various equivalents, alternatives, and modifications are possible within the scope of the appended claims.

Figure 1:
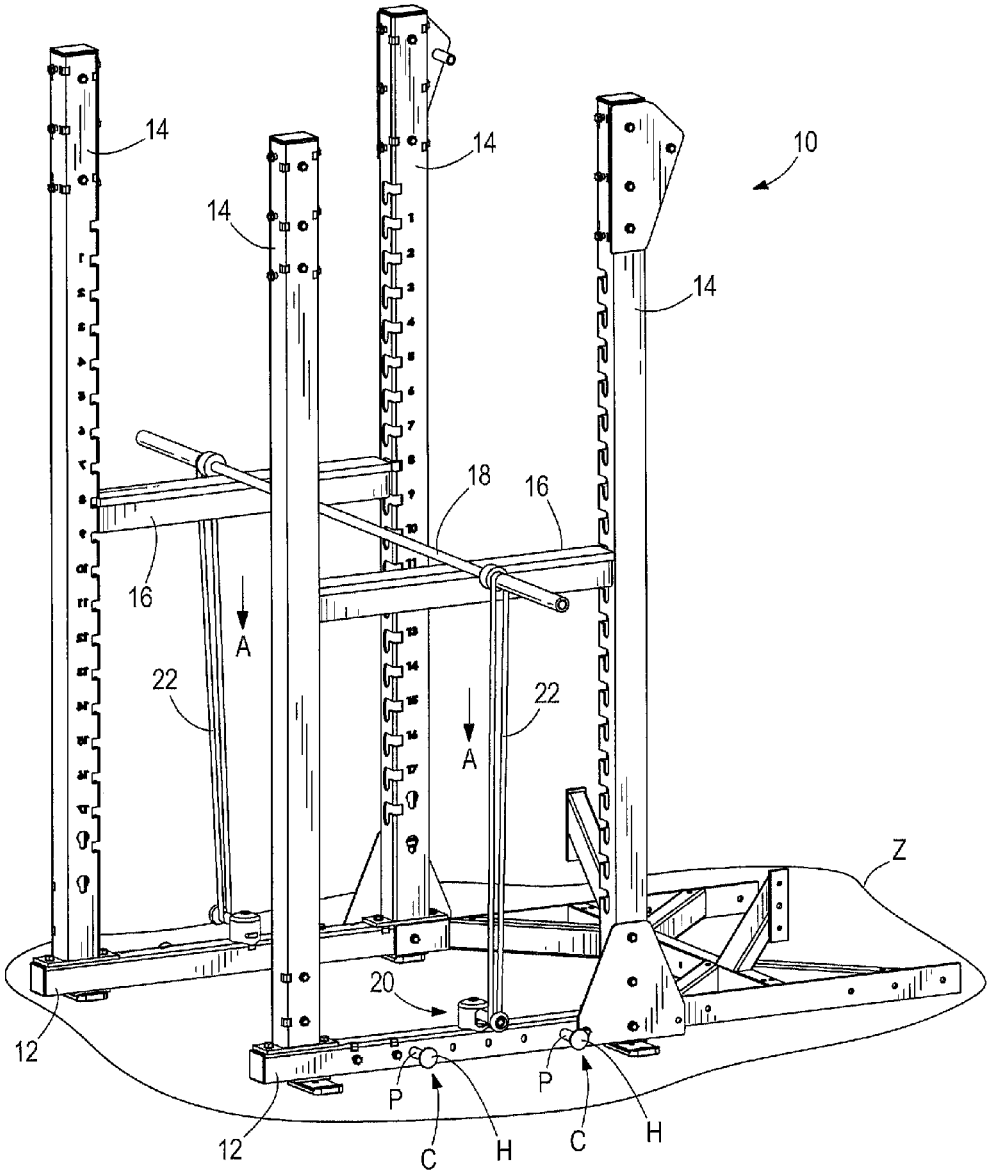
FIG. 1 is a perspective view of exercise equipment having an adjustable band peg assembly.

FIG. 1 depicts exercise equipment 10, which in the examples shown is weight training equipment. The exercise equipment 10 has an axially extending base frame 12, four generally vertically extending frame members 14, and two axially extending support bars 16 that are vertically spaced above the base frame 12. The configuration and orientation of the base frame 12, frame members 14 and support bars 16 is exemplary and can significantly vary with the scope of the present disclosure. The exercise equipment 10 generally defines an exercise zone Z in and around the base frame 12, wherein a user can perform exercises. Again, the configuration of the exercise zone can vary and will depend on the particular configuration of the exercise equipment 10. In this example, a weight bar 18 is resting on and supported by the support bars 16. Fixed band pegs P are provided on the base frame 12. A pair of elastic bands 22, which in the examples shown are rubber bands, are extending between opposing ends of the weight bar 18 and a band peg assembly 20 so as to bias the weight bar 18 towards the support bars 16 in the direction of arrow A at least when the weight bar 18 is moved vertically with respect to the support bar 16. The band peg assembly 20 will be described further with respect to drawing FIGS. 2-6, herein below.

In FIG. 1, the exercise equipment 10 is configured for a user to perform weightlifting exercises in the exercise zone Z by, among other things, repeatedly lifting the weight bar 18. As will be understood by those having ordinary skill in the art, the exercise equipment 10 can be alternately configured for use with many different types of exercises. In one non-limiting example, a bench (not shown) can be provided in the exercise zone Z for supporting the user while the user performs weightlifting exercises with the weight bar 18, or with other free weight devices such as dumbbells, chains, exercise balls, and/or the like. As mentioned above, in some exercises, the elastic bands 22 can extend between the opposing ends of the weight bar 18 and band pegs P on the base frame 12, located on the floor in the exercise zone Z. In other exercises, metal chains (not shown) each having a plurality of links are attached to and suspend from free weight devices, such as from the opposing ends of the weight bar 18, to vary the resistance to the user. The free ends of such metal chains typically gather on the floor during lifting of the noted free weight devices.

Through research and experimentation, the present inventors have realized that fixed band pegs, such as the examples P shown in FIG. 1, can be difficult to use and in some instances present an obstruction. For example, the fixed band pegs P shown in FIG. 1 are typically located close to the floor and have an end cap C with a flat head H. There is typically very little clearance space between the bottom of the flat head H and the floor surface, such that the inventors have realized that it can be burdensome for a user to reach down and manually fit the rubber bands around the band pegs P. Further, exercise chains that gathered on the floor in the exercise zone Z can become tangled with the fixed band peg P, especially because the chains are often connected to heavy free weight devices. Entanglement between the fixed band peg P and the exercise chain often results because a link of the chain can easily fit over the flat head H of the fixed band peg P. The present inventors sought to remedy these problems and have arrived at the following embodiments of exercise equipment and adjustable band pegs for exercise equipment.

Figure 2:
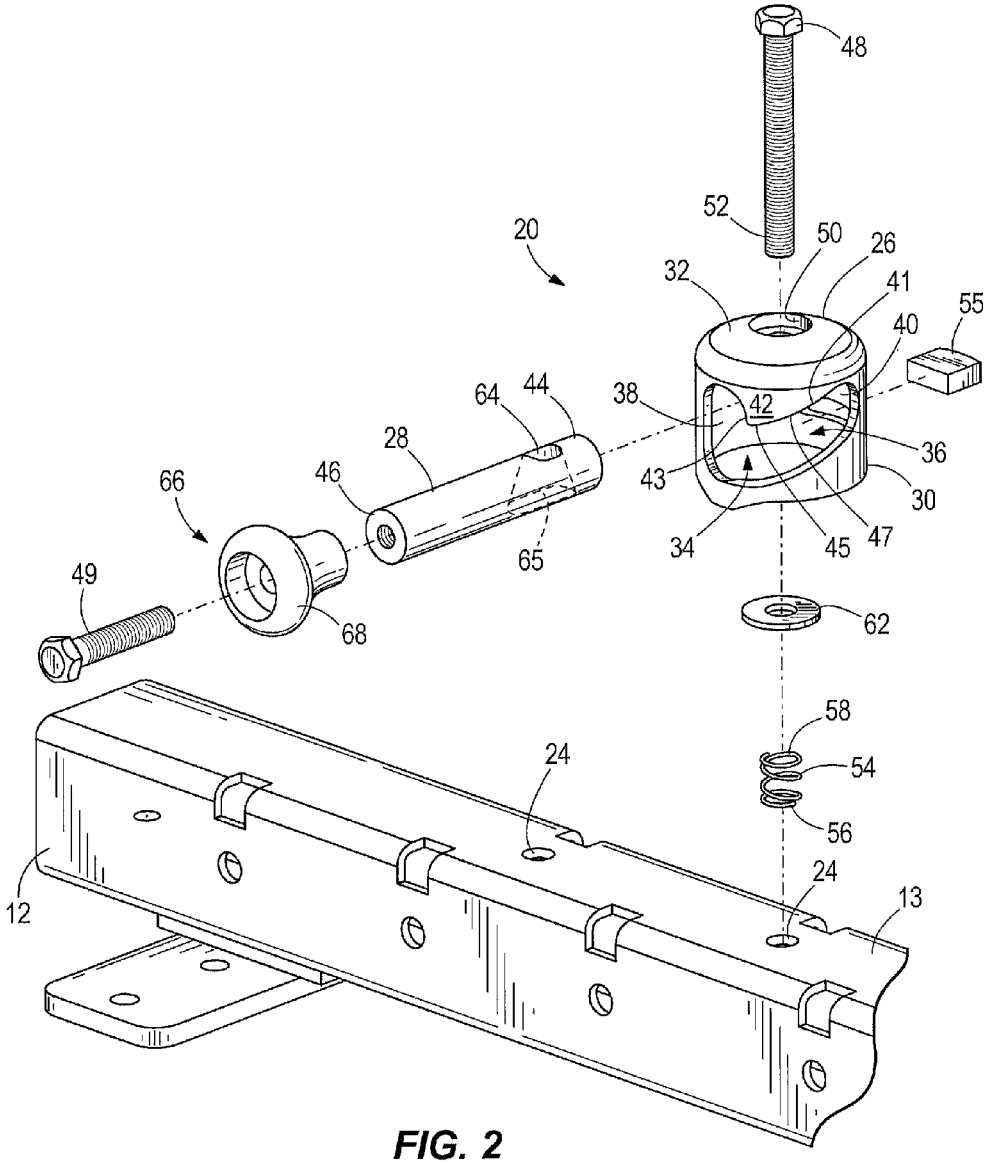
FIG. 2 is an exploded view of the band peg assembly in FIG. 1.
Figure 3:
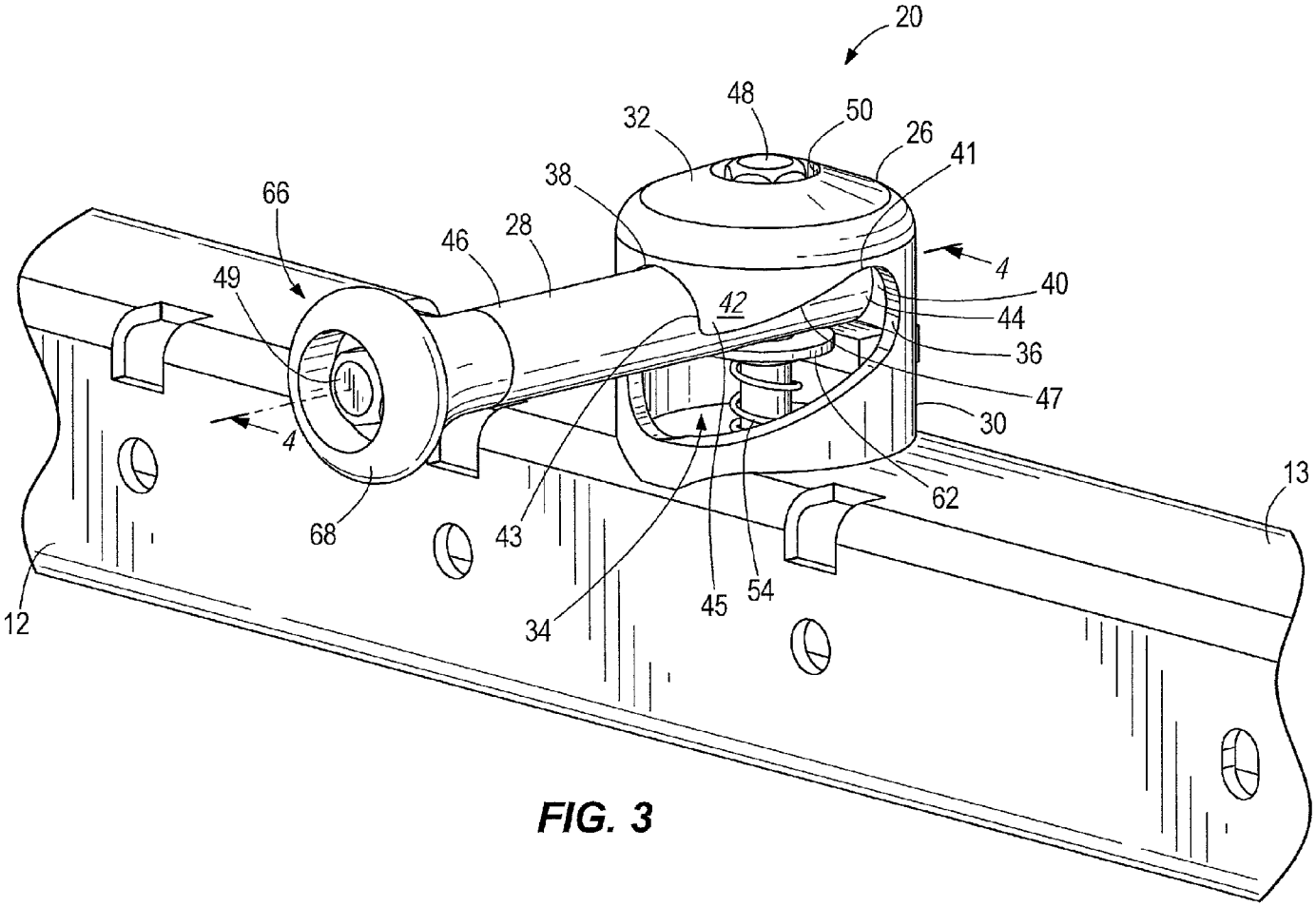
FIG. 3 is a perspective view of the band peg assembly.
Figure 4:
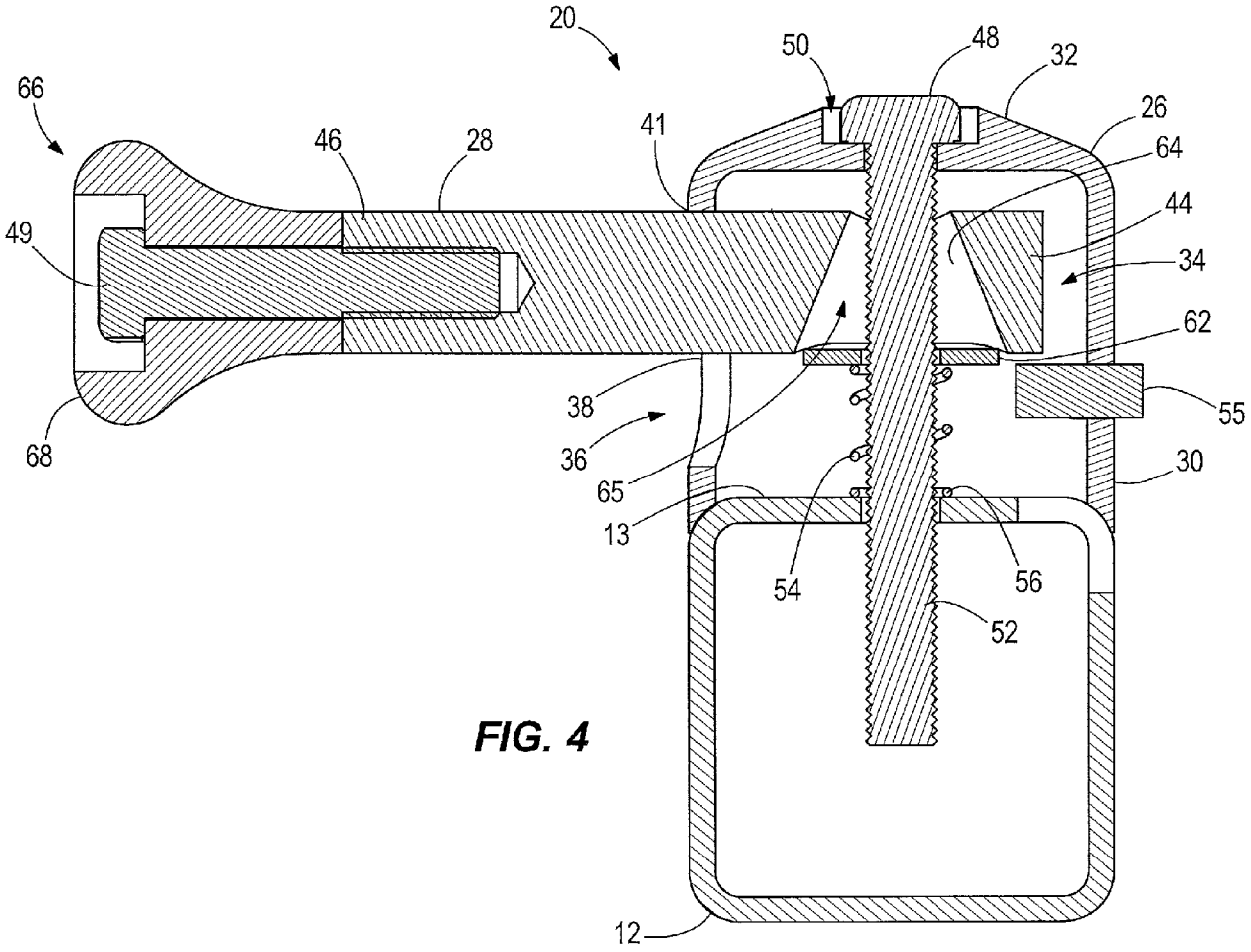
FIG. 4 is a view of Section 4-4 taken in FIG. 3.

Referring to FIGS. 2-4, base frame 12 is shown having at least one band peg assembly 20, which is attached to a top surface 13 of the noted base frame 12, which has a plurality of holes 24 therein. In this example, the band peg assembly 20 includes a housing 26 and a band peg 28 that is connected to the housing 26 so as to be selectively movable between an active position, shown in FIG. 3 wherein the band peg extends into the exercise zone Z of the exercise equipment 10 and an inactive position, shown in FIG. 6, wherein the band peg 28 is retracted away from the noted exercise zone Z. In the active position the band peg 28 extends transversely with respect to the axially extending base frame 12 and in the inactive position the band peg 28 extends parallel to the axially extending base frame 12. However the orientation of band peg assembly 20 can vary from that which is shown. The housing 26 can be a separate component, or can be an integral part of the exercise equipment 10, such as the noted base frame 12, frame members 14 and/or support bars 16.

In this example, the housing 26 is cylindrical-shaped and has a sidewall 30 and top wall 32 that together define an open cylindrical-shaped interior 34. The shape and orientation of the housing 26 can vary from that which is shown, as discussed herein above. An opening 36 is formed in the sidewall 30 of the housing 26. The shape and orientation of the opening 36 can also vary from that which is shown. In this example, the opening 36 has an active portion 38 through which the band peg 28 extends when it is in the noted active position shown in FIG. 3. The opening 36 also has an inactive portion 40 through which the band peg 28 extends when it is in the inactive position, shown in FIG. 6. A ridge 42, which in this example is part of the sidewall 30, extends into the opening 36 between the noted active and inactive portions 38, 40. The ridge 42 is located along an upper side 41 of the opening 36 and has a contour including a generally curved and vertically extending surface 43, a curved peak surface 45, and a sloped camming surface 47 extending away from the curved peak surface 45. The contour of the opening 36 controls the extent of movement of the band peg 28, as will be discussed further herein below with reference to FIGS. 5 and 6. For example, the ridge 42 prevents or blocks lateral rotational movement of the band peg 28 from the active position to the inactive position.

The band peg 28 has a first end 44 that is located inside the housing 26 and a second end 46 that is located outside of the housing 26. A fixing member 48, which in this example is a bolt, fixes the band peg 28 to the housing 26. More specifically, the fixing member 48 vertically extends through an opening 50 in the housing 26. The orientation and configuration of the fixing member 48 can vary from that which is shown. A threaded end 52 of the fixing member 48 is joined to hole 24 in the axially extending base frame 12. A compression spring 54 is disposed around the fixing member 48. The spring 54 has a bottom end 56 that acts on the top surface 13 of the axially extending base frame 12. The spring 54 also has a top end 58 that acts on a washer 62, which in this example is a flat washer. Other shapes of washer 62 could be used, such as for example a conical or flattened conical shaped washer could be used.

The fixing member 48 extends through a through-bore 64 in the first end 44 of the band peg 28. The through-bore 64 defines a flattened conical space 65 through which the fixing member 48 extends. The flattened conical space 65 of through-bore 64 allows rotation and pivoting movement of the band peg 28 along the contour of the opening 36 in the direction of arrow B (see FIG. 5) against the bias of spring 54. A shaft support 55 extends into the open interior 34 of the housing 26 and prevents the first end 44 of the band peg 28 from moving vertically downwardly when the a vertically upward force is applied on the second end 46 of the band peg 28, such as for example by the noted elastic bands 22. An end cap 66 is disposed on the second end 46 of the band peg 28. The end cap 66 has a toroidal outer end 68 and is fastened to the second end 46 of the band peg 28 by a fastener 49, which in this example is a bolt. Other types of fasteners could be employed.

Figure 5:
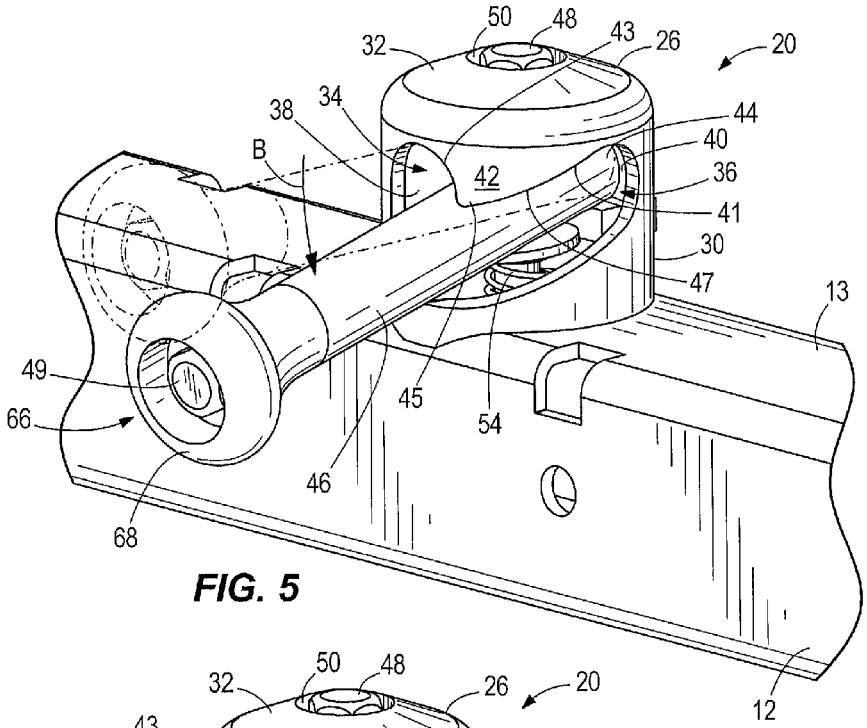
FIG. 5 is a perspective view of a movable band peg.
Figure 6:
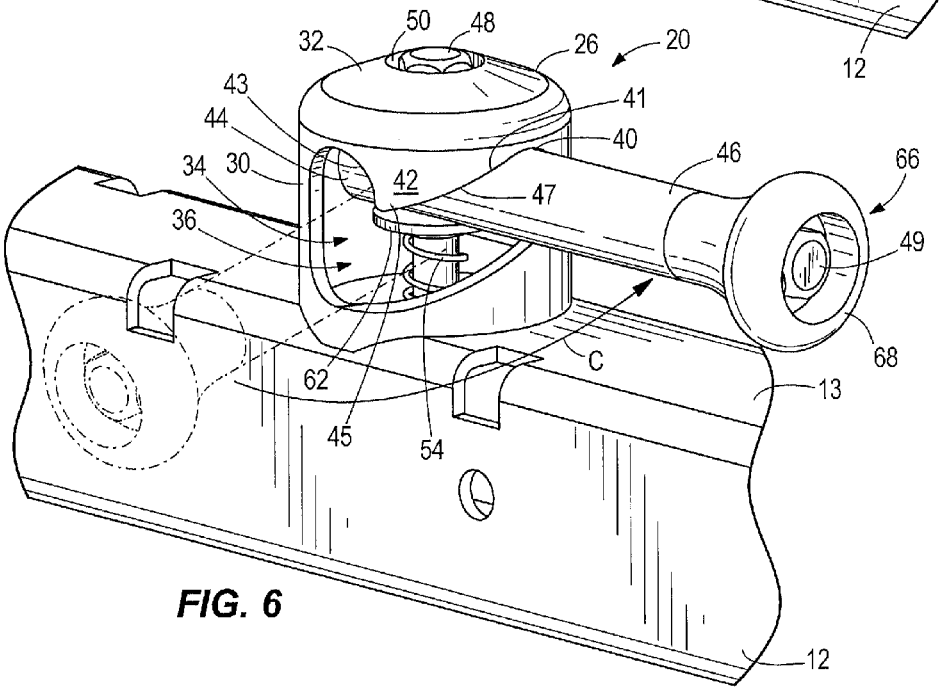
FIG. 6 is a perspective view of the band peg in an inactive position.

Referring to FIGS. 5 and 6, the band peg 28 is biased by the spring 54 into the active and inactive positions. Pivoting movement of the band peg 28 in the direction of arrow B against the bias of the spring 54 allows for rotational movement in the direction of arrow C from the active position to the inactive position, and vice versa in opposite the direction of arrow C from the inactive position to the active position. Pivoting movement of the band peg opposite the arrow B, allows the bias to register the band peg 28 in the noted active and inactive positions and thereby prevents the rotational movement shown in the figures. Rotational movement is prevented by the noted ridge 42 that extends into the opening 36 between the active and inactive portions 38, 40 of the opening 36.

Movement of the band peg 28 from the active position to the inactive position is easily accomplished in this illustrated example, and can for example be accomplished by user pushing down on the outer end 68 of the end cap 66 (for example with the user's hand or foot) until the band peg 28 clears the peak surface 45, and then rotating the band peg 28 in the direction of arrow C. As the band peg 28 is rotated it slides along the camming surface 47 and is biased into the inactive position. Rotation of the band peg 28 out of the exercise zone Z thus removes the second end 46 of the band peg 28 from an area where it will likely become tangled with peripheral exercise devices, and thus presents less of an obstruction and risk to the user. Movement of the band peg 28 from the inactive position is also easily accomplished in this illustrated example, and can for example be accomplished by the user pushing on the outer end 68 of the end cap 66 (for example with the user's hand or foot) so that the band peg 28 is cammed downwardly against the bias of the spring by the camming surface 47 and over the peak surface 45, at which point the band peg 28 is biased by the spring 54 into the active position.

The band peg assembly 20 is located above the profile of the base frame 12 and thus compared to the prior art it is much easier for the user to loop an elastic band 22 on and off the band peg 28. The tube shape of the outer end 68 of the end cap 66 is less likely to catch on external devices, such as exercise chains, and therefore presents less of an obstruction and risk to the user.

What is claimed is:

1. An adjustable band peg assembly for exercise equipment located in an exercise zone where a user performs exercises, the assembly comprising: a housing with an opening; a rotatably movable band peg that is connected to the housing so as to be selectively movable between an active position wherein the band peg extends into the exercise zone and an inactive position wherein the band peg is retracted away from the exercise zone; and a ridge extending into the opening between the active and inactive portions, wherein the ridge blocks movement of the band peg from one of the active position and the inactive position to the other of the active position and the inactive position, wherein the band peg is biased into the active and inactive positions, wherein pivoting movement of the band peg against the bias allows the rotational movement from the active position to the inactive position or from the inactive position to the active position, wherein the opening has an active portion through which the band peg extends when the band peg is in the active position and an inactive portion through which the band peg extends when the band peg is in the inactive position, wherein the ridge comprises a camming surface that cams the band peg against the bias when the band peg is rotated from one of the active position and inactive position to the other of the active position and inactive position, and wherein pivoting movement of the band peg against the bias allows rotating movement of the band peg past the ridge from the active portion of the opening to the inactive portion of the opening or from the inactive portion of the opening to the active portion of the opening.

2. The assembly according to claim 1, wherein the band peg has a first end located inside the housing and a second end located outside of the housing, and further comprising a fixing member fixing the band peg to the housing.

3. The assembly according to claim 2, comprising spring on the fixing member, the spring biasing the band peg into the active and inactive positions, respectively.

4. The assembly according to claim 2, wherein a flattened conical space is defined in the band peg, the flattened conical space configured to allow pivoting movement of the band peg with respect to the fixing member.

5. The assembly according to claim 4, wherein the flattened conical space is defined by a through-bore in the band peg.

6. The assembly according to claim 1, wherein the band peg comprises an end cap having an outer end that is toroidal.

7. Exercise equipment for use in an exercise zone where a user performs exercises, the exercise equipment comprising: an axially extending base frame; a band peg connected to the base frame so as to be selectively and rotatably movable between an active position wherein the band peg extends into the exercise zone transverse to the axially extending base frame and an inactive position wherein the band peg is retracted away from the exercise zone parallel to the axially extending base frame, and wherein the band peg is biased into the active and inactive position such that pivoting movement of the band peg against the bias allows the rotational movement of the band peg between the active position and the inactive position; a housing having an opening wherein the opening has an active portion through which the band peg extends when the band peg is in the active position and an inactive portion through which the band peg extends when the band peg is in the inactive position; and a ridge disposed between the active and inactive portions of the opening, wherein the ridge blocks rotational movement of the band peg between the active position and the inactive position.

8. The assembly according to claim 7, wherein the band peg is biased into the active position and wherein the band peg is also biased into the inactive position; wherein pivoting movement of the band peg against the bias allows rotational movement of the band peg past the ridge.

9. The assembly according to claim 7, wherein the ridge is located along an upper side of the opening and comprising a spring that biases the band peg towards the upper side of the opening.

10. Exercise equipment for use in an exercise zone where a user performs exercises, the exercise equipment comprising: an axially extending base frame; a housing with an opening attached to a top surface of the axially extending base frame; a band peg connected to the housing so as to be selectively movable between an active position wherein the band peg extends into the exercise zone and an inactive position wherein the band peg is retracted away from the exercise zone; and a laterally extending support bar spaced vertically above the base frame, the support bar configured to support a weight bar having at least one of chains or rubber bands attached thereto, wherein in the active position the band peg extends transversely with respect to the axially extending base frame so as to interfere with the at least one of chains or rubber bands on the weight bar and wherein in the inactive position the band peg extends parallel to the axially extending base frame so as not to interfere with the at least one of chains or rubber bands on the weight bar, wherein the opening has an active portion through which the band peg extends when the band peg is in the active position and an inactive portion through which the band peg extends when the band peg is in the inactive position; and further comprising a ridge disposed between the active and inactive portions of the opening, wherein the ridge blocks rotational movement of the band peg from the active position to the inactive position or from the inactive position to the active position.

* * * * *